US009303961B1

(12) United States Patent
Frericks et al.

(10) Patent No.: US 9,303,961 B1
(45) Date of Patent: Apr. 5, 2016

(54) MODULAR CHARGE SYSTEM

(71) Applicants: Lonnie Frericks, King George, VA (US); Thomas Higdon, LaPlata, MD (US); Michael D Lincoln, Litchfield, NH (US); Bob Brush, Virginia Beach, VA (US); Mitchell Hovenga, Virginia Beach, VA (US)

(72) Inventors: Lonnie Frericks, King George, VA (US); Thomas Higdon, LaPlata, MD (US); Michael D Lincoln, Litchfield, NH (US); Bob Brush, Virginia Beach, VA (US); Mitchell Hovenga, Virginia Beach, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/998,208

(22) Filed: Oct. 11, 2013

(51) Int. Cl.

| | |
|---|---|
| ***F42B 3/02*** | (2006.01) |
| ***F42B 3/08*** | (2006.01) |
| ***F42B 1/02*** | (2006.01) |
| ***F42B 1/028*** | (2006.01) |
| ***F42B 1/032*** | (2006.01) |
| *F42B 12/10* | (2006.01) |

(52) U.S. Cl.
CPC . *F42B 1/028* (2013.01); *F42B 1/02* (2013.01); *F42B 1/032* (2013.01); *F42B 3/02* (2013.01); *F42B 3/08* (2013.01); *F42B 12/10* (2013.01)

(58) Field of Classification Search
CPC ..... F42B 1/00; F42B 1/02; F42B 1/028; F42B 3/08; F42B 3/22; F42B 12/10; F42B 12/16; F42B 12/18; F42B 1/032; F42B 3/02
USPC ..... 102/306, 307, 308, 309, 310, 314, 317, 102/320, 331, 332, 476; 89/1.15
See application file for complete search history.

(56) References Cited

U.S. PATENT DOCUMENTS

| | | | | |
|---|---|---|---|---|
| 3,008,417 | A * | 11/1961 | Keathley et al. | 102/287 |
| 4,051,696 | A | 10/1977 | Mason et al. | |
| 4,382,409 | A | 5/1983 | Burns | |
| 6,899,032 | B2 * | 5/2005 | Ronn et al. | 102/307 |
| 7,004,075 | B2 * | 2/2006 | Ronn et al. | 102/473 |
| 7,066,093 | B2 * | 6/2006 | Ronn et al. | 102/489 |
| 7,299,735 | B2 | 11/2007 | Alford | |
| 7,707,940 | B2 * | 5/2010 | Lebacher | 102/434 |
| 8,146,500 | B2 * | 4/2012 | Frieden | 102/320 |
| 8,336,461 | B2 * | 12/2012 | Reinmuller | 102/476 |
| 2005/0126420 | A1 * | 6/2005 | Givens et al. | 102/310 |
| 2010/0018427 | A1 | 1/2010 | Roland et al. | |

OTHER PUBLICATIONS http://en.wikipedia.org/wiki/Krakatoa_(explosive.

* cited by examiner

*Primary Examiner* — James S Bergin

(57) ABSTRACT

A modular charge system based on a standard module fitted with a flying plate or a liner and axially coupled to other modules to configure the size and type of charge. The explosive is enclosed in a casing, which has a cylindrical wall with a plurality of external longitudinal rails that run lengthwise. The rails are substantially parallel, and approximately equidistantly spaced around the perimeter of the casing. The space between a pair of rails defines a channel. The casing rails function as a cylindrical tamper. The explosive is partitioned into removable portions and permanent portions, where the removable portions are separated from the permanent portions and any retained removable portions, therein enabling the module to be fitted with a variety of flying plates, liners and other hardware. Modules may be coupled utilizing internal slides, positioned in the channels to join modules.

20 Claims, 7 Drawing Sheets

MODULAR CHARGE SYSTEM

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to explosive tools and more particularly to a modular system of explosive tools that condenses the capabilities available from multiple explosives and explosive tools into one standard module.

2. Background

The US Army's special operations forces have performed demolition operations dating back to pre-World War II using bulk explosives and non-standard, improvised methods. Soldiers have used materials found in the field such as junk yard scrap, glass champagne bottle bottoms and steel plates and molded the explosive to them in an attempt to increase the efficiency of the charges for specialized missions. Since the advent of munitions incorporating explosively formed penetrators/projectiles (EFPs) as warheads, the special operations forces have learned to build demolition charges using this technology. Often times, through trial and error, the mission succeeded using the improvised demolition charges to neutralize the target. However, improvised EFPs are rarely optimized nor do they have consistent and reliable performance because of the variability in materials and building techniques employed.

To overcome some of these deficiencies, demolition kits have been developed for the Navy's Seals and the Army's Special Operations Forces soldiers. Typically, a kit has included a collection of inert metal and plastic parts and commercially available items that give soldiers a wide selection of warheads and attachment devices which can tailored to neutralize a specific target. Many kits have various warheads, at least three sizes of conical shaped charges, four sizes of linear shaped charges, where the relative dimensions stay about the same, the size is just increased. As the kits have evolved to have greater capabilities, so has the weight. The warheads that are provided have a pre-set configuration that contains all materials, except the explosive. The explosive still has to be packed into the warheads. Currently, the demolition kit also has inert components to tailor-make various explosive charges and devices to attach or aim these charges at the target.

Near the mission jump-off site, the user will select the proper sized warheads and hand pack the warheads with Composition C-4 moldable explosive. The armed warheads are manually carried in a backpack to the target site.

SUMMARY OF THE INVENTION

The disclosed invention, in one exemplary aspect, is a modular charge system (MCS) that is uniquely suitable to be utilized in dismounted operations (particularly explosive ordnance disposal operations), where dismounted operations require that potentially everything has to be manually carried, for instance in a backpack. It is anticipated that there are no particular size limitations, but that some sizes are more easily handled without mechanical assistance, either for larger or smaller modular charge systems. The invented system enables a relatively small suit of devices to assemble multiple types of charges including shape charges (SC), explosively formed projectiles (EFPs), explosively driven flyer plates (FPs), contact charges (CC), linear shape charges (LSC), strip charges (STRPC), and other explosive tools, such as those employed to breach an obstacle. The invented system condenses and consolidates the capabilities available from multiple explosives and explosive tools into a substantially relatively lightweight suit of devices, which is suitable for dismounted operations.

A standard module is loaded with explosive, and while some trimming may be necessary, hand packing the explosive is not, required. The standard module may be used alone or in combination with multiple other compatible modules. The standard module has a casing with a substantially cylindrical wall, where the cylindrical wall has a plurality of external longitudinal rails that run the length of the casing. The casing with rails functions as a cylindrical tamper around the explosive charge. The rails are parallel (like tracks), and they are approximately equidistantly spaced around the perimeter of the casing, where the space between a pair of rails defines a channel.

A second exemplary aspect of the invention is that each rail includes multiple sides including an upper left side, a upper right side, a left under side, a right under side, and a bottom that is contiguous with a perimeter wall of the casing. In contrast to conventional rails, which have a flat upper surface, the upper left side and the upper right side of the rails have an upper surface that is sloped. The upper left side and the upper right side intersect forming an apical edge. In stark contrast to spline-like rails, which can have a similar apical edge, the left under side and the right under side of each of the casing's rails are undercut, each side forming a sloped undercut surface. As will be discussed later, the morphology of the rail imparts very useful features to the casing with rails.

Another exemplary aspect of the invention is that each standard module, potentially, may be axially coupled to another standard module, such that a plurality of standard modules may be coupled, therein condensing and consolidating multiple explosives and explosive tools into a few relatively lightweight devices. Coupling is effected without the need of threaded joints or even twist locking, which would change the orientation of one standard module relative to a joined standard module. The invented method of coupling results in an interface that intrinsically produces an accurate sight, and a mechanism for attaching other sighting systems. The aligned rails themselves serve as a sighting mechanism, and additionally enables the mounting of various ancillary sighting devices, and therefore various configurations of the modular charge system can be effectively aimed. Examples of ancillary sighting devices includes a gun sight (front, rear, flip-up), scope sights on a Picatinny rail, such as a Trijicon Tall Picatinny Rail Mount, and using a stand, such as a tripod, where the stand has a sighting mechanism. The system enables substantially all of the several shape charge configurations to be held at a fixed distance from a target by an apparatus, such as an extended pole, sometimes known as a pigstick.

The coupling mechanism of the modular charge system utilizes elongate internal slides, positioned in the channels to join one standard module to an adjacent standard module. When positioned, a slide spans from one sectional length of channel between a pair of rails to a second sectional length of channel of the adjacent standard module, thereby joining the two standard modules. Stop elements, such as screws, notches and snap-on-positioning elements, may be incorporated in the elongate internal slides to position, fixedly, the location of the internal slides in the channels.

An important aspect of the invention is that for a given suit of tools, where various liners, igniters and other components are also considered tools, the modules are standardized. Standardization includes size, morphology, and partitioning of the explosive; therein enabling an assemblage of multiple types of charges to be configured to have a range of total weight of explosive, even though the size of an individual standard module remains the same. Exemplary types of charges include: shape charges (SC), explosively formed projectiles (aka penetrators)(EFPs), explosively driven flyer plates (FPs), contact charges (CC) for cutting, linear shape charges (LSC), strip charges (STRPC), and multiple explosive types of charges for breaching obstacles.

The standard module may be modified in the field to have variations in the shape and the amount of the explosive, so as to meet the needs for the mission. For instance, in a first variation the explosive is partitioned into longitudinal portions, where the longitudinal portions are substantially either permanent or removable. If the explosive is removable, then it can be separated from the permanent portions and any other removable portions that remain in the standard module. When a removable portion is removed, it is normally replaced with an appropriate liner(s) as needed. The shape of the removable explosive portions is not limited, but two useful shapes are a semi-circular wedge and an elliptical wedge, where one (or more) of the removable wedges is removed when configuring standard modules to a type of charge such as a LSC, CC, STRPC and a EFP with a bar-like liner. In a second variation of the standard module, the explosive is recessed from a rim of the casing, and the explosive has at least one removable conical explosive portion such that when removed, the standard module may be fitted with a conical liner forming a shaped charge that is an EFP with a conical liner. Alternatively, the explosive may be left untouched and the standard module may be fitted with a plate forming an explosively driven flyer plate (FP).

In substantially all scenarios the modular system includes an access port for a shock tube, blasting cap or other igniter, where the access port is located on a casing floor or in a casing portal. The access port is generally mounted proximate to the bulk of explosive, usually opposing the liner.

BRIEF DESCRIPTION OF THE DRAWINGS

The foregoing invention will become readily apparent by referring to the following detailed description and the appended drawings in which.

DETAILED DESCRIPTION OF THE INVENTION

The modular charge system is based on a standard module that may be fitted with a flying plate, a liner or other hardware and may be axially coupled to other modules configuring the size and type of charge. The explosive is enclosed in a casing, which has a cylindrical wall with a plurality of external longitudinal rails that run lengthwise. The rails are substantially parallel, and approximately equidistantly spaced around the perimeter of the casing. The space between a pair of rails defines a channel. The casing rails function as a cylindrical tamper. The explosive is partitioned into removable portions and permanent portions, where removable portions may be separated from the permanent portions and any retained removable portions, therein enabling the module to be to be fitted with a variety of flying plates, liners and other hardware. Modules can be coupled utilizing elongate internal slides, positioned in the channels to join modules.

Figure 1:
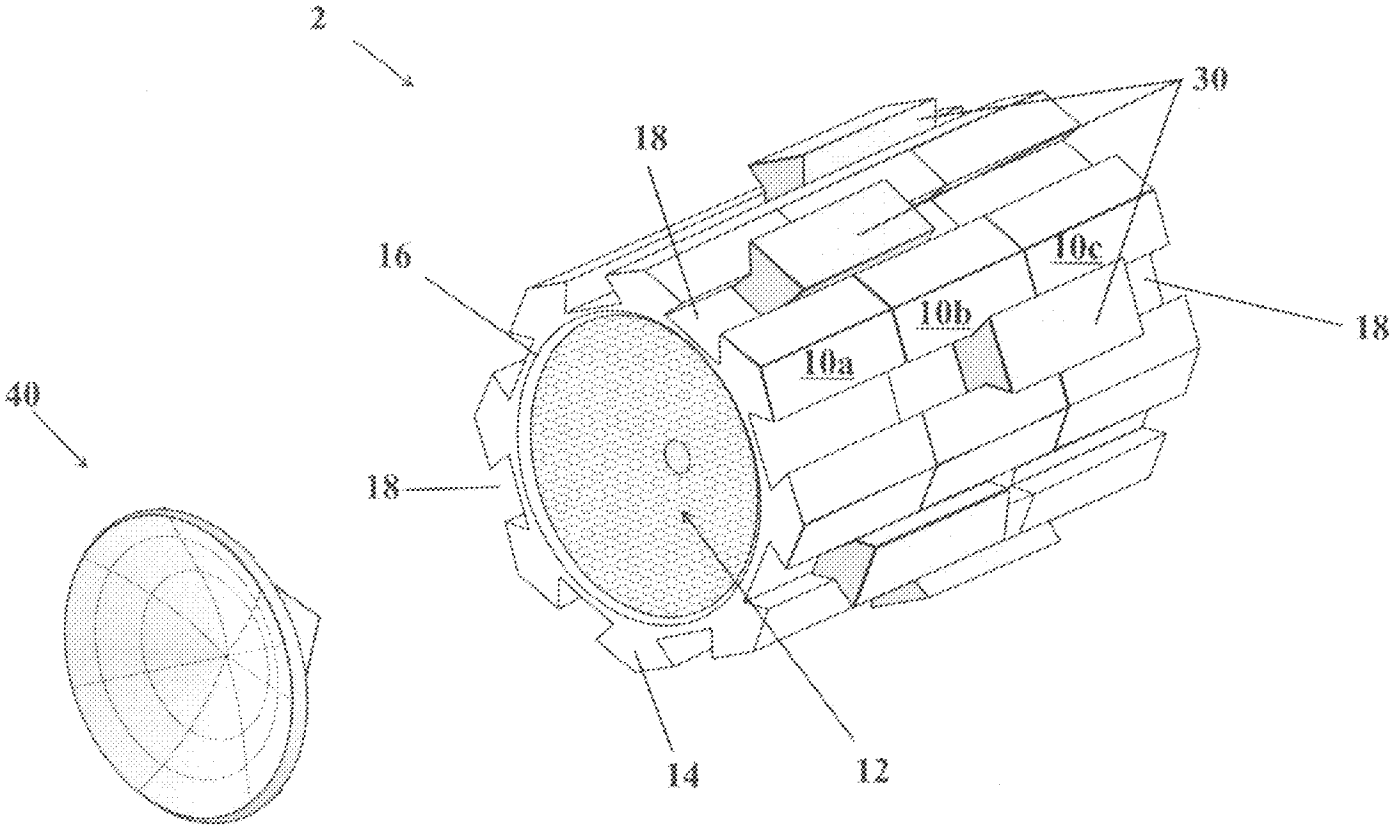
FIG. 1 is a partially exploded view of an exemplary illustration of the invention, where the invention is a modular charge system that is an integrated combination of shaped charges and tools, where a common component of the system is a plurality of standardized modules, where each module may be configured to work in combination with another module, the combination producing a consolidated assortment of explosive charges, such as the illustrated shaped charge (SC), which includes explosively formed projectiles (EFPs)
Figure 1A:
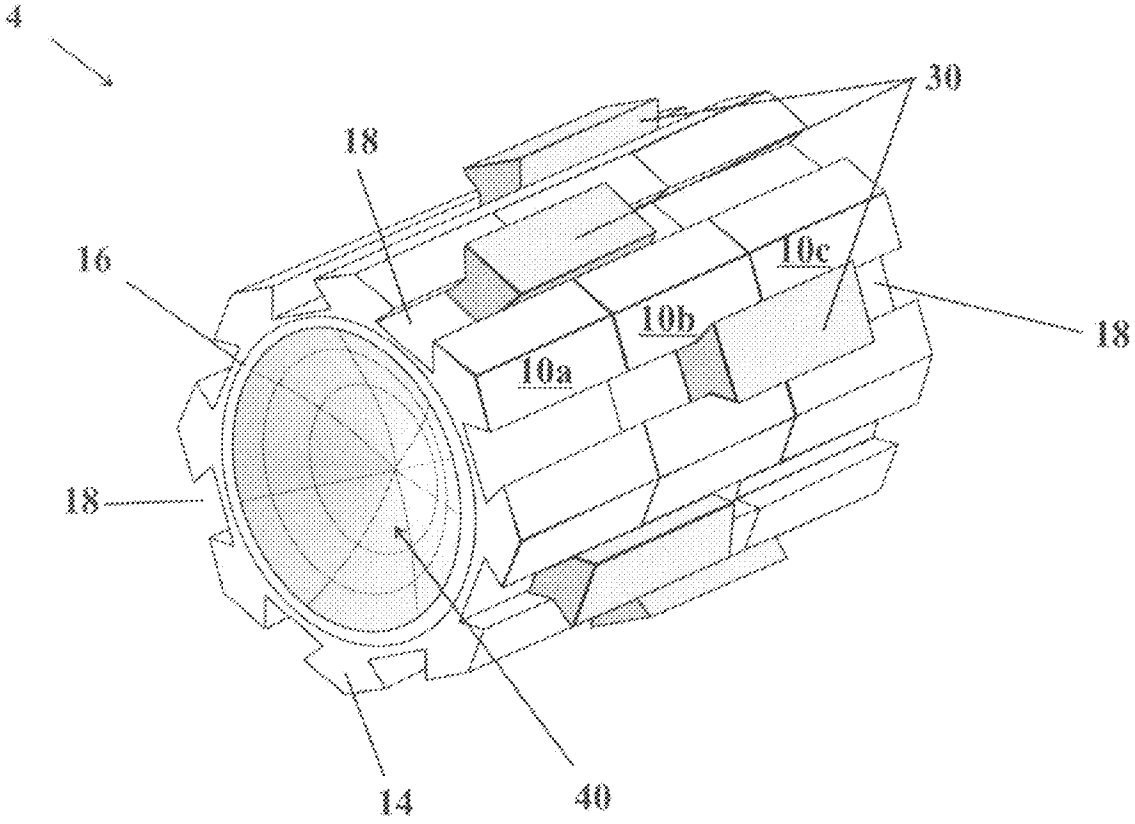
FIG. 1*a* is a perspective view of a multi-module EFP.

Referring to FIG. 1, which is a partially exploded exemplary view of a type of charge configured from the modular charge system. The illustrated type of charge is a shaped charge 2, configured with three coupled standard modules 10*a*, 10*b* 10*c*. The modules are coupled with a plurality of elongate internal slides 30, positioned in the channels 18 of paired rails 14, and span a pair of coupled modules. In this instance, module 10*b* is coupled to both 10*a* and 10*c*. The shape of the charge in module 10*a* is substantially conical, and it is covered with a liner 40. Shape charges only need a relatively thin liner with enough to protect the explosive, and the charge is configured with a changeable liner material comprised of copper, magnesium, aluminum, and glass. Heavier liners are used in explosively formed projectile (EFP) 4 to produce a projectile, and as shown in FIG. 1*a* the liner 40 is inserted in module 10*a*, where all the modules have a cylindrical casing 16 with perimeter external longitudinal rails 14. The illustrated heavier liner is thicker and composed of copper.

Figure 2:
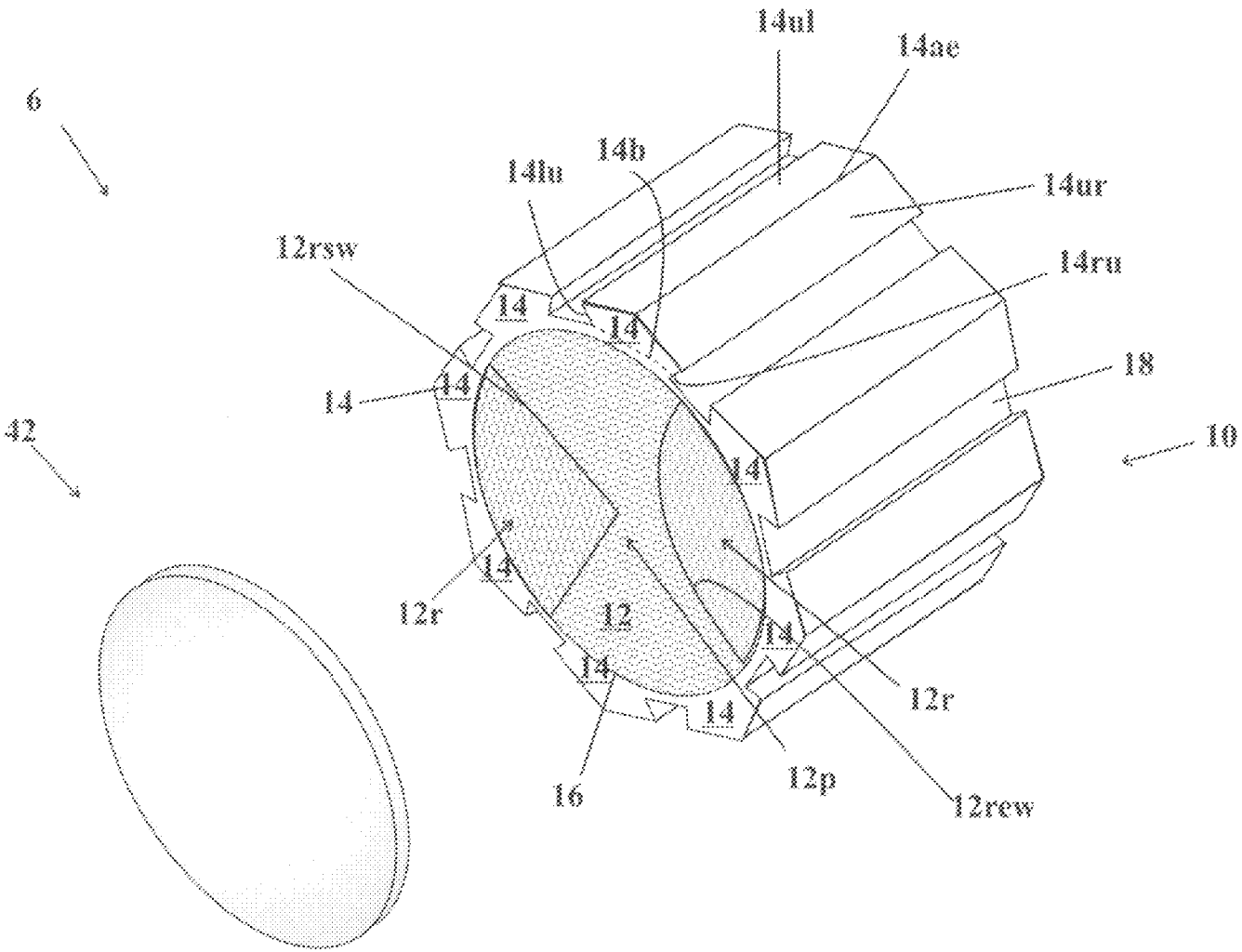
FIG. 2 is a substantially perspective view of a standard module that may be fitted with an explosively driven flyer plate (FP), where the explosive is partitioned into removable portions including a removable, semi-circular wedge of explosive for configuring a linear shape charge (LSC) and a removable elliptical wedge of explosive for configuring a hemispherical charge and a strip charge (STRPC) which launches a bar of metal, ceramic or other material.

Referring to FIG. 2, which is a substantially perspective view of a standard module 10 configured as an explosively driven flyer plate 6, where the flyer plate 6 is changeable. Generally, the plate is made of iron, copper, aluminum, other metals and alloys thereof. The explosive 12 is partitioned into permanent portions 12*p* and removable portions 12*r*, including a removable semi-circular wedge 12*rsw* of explosive for configuring a linear shape charge (LSC) as well as a removable elliptical wedge 12*rew* of explosive for configuring a hemispherical charge, and a strip charge (STRPC), which launches a bar of metal, ceramic or other material. Each rail 14 includes multiple sides including an upper left side 14*ul*, a upper right side 14*ur*, a left under side 14*lu*, a right under side 14*ru*, and a bottom 14*b* (see dashed line) that is contiguous with a perimeter wall of the casing. In contrast to conventional rails, which have a flat upper surface, the upper left side 14*ul* and the upper right side 14*ur* of the rails is sloped. The upper left side and the upper right side intersect forming an apical edge 14*ae*. In stark contrast to spline-like rails, the left under side 14*lu* and the right under side 14*ru* of each of the casing's rails are undercut, each under side forming a sloped undercut surface. The apical edge 14*ae* is intrinsically a sighting device.

Another feature one may partially see in FIG. 1 is that the slide has V-shaped notches on opposing edges, such that the upper side of the notch will contact the upper sides of a pair of rails, and the lower side of the notch may contact the lower sides of that pair of rails.

Figure 3B:
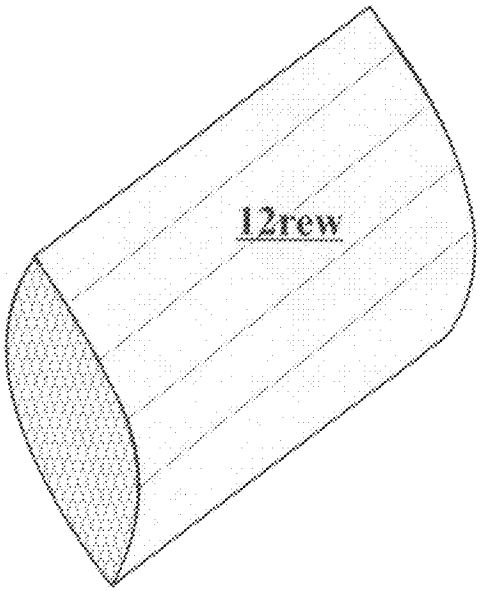
FIG. 3*b* is an overhead perspective view of the removable elliptical wedge of explosive outlined in FIG. 2.
Figure 3A:
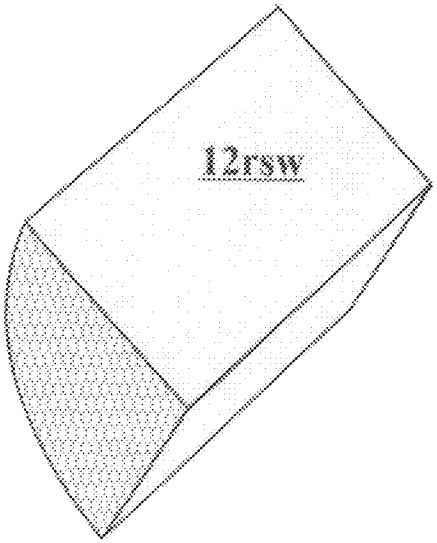
FIG. 3*a* is an overhead perspective view of the removable semi-circular wedge of explosive outlined in FIG. 2.
Figure 3C:
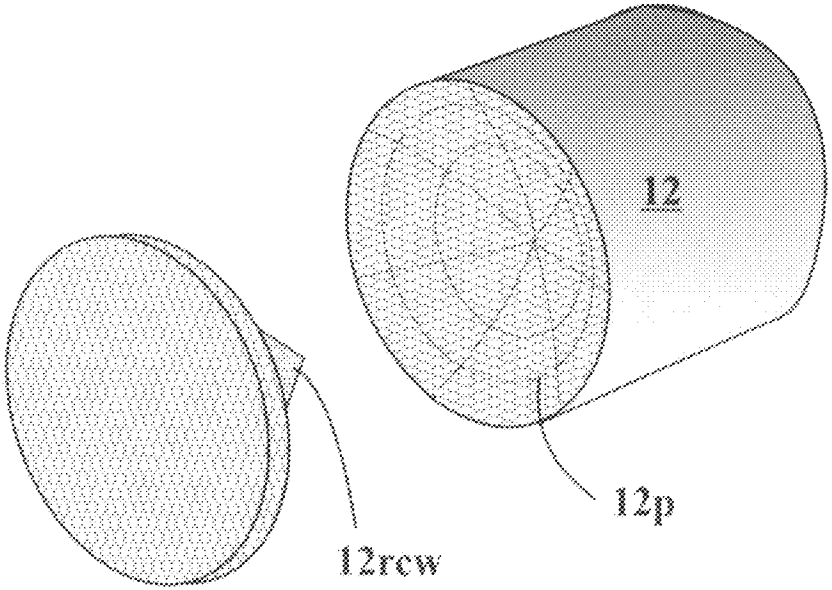
FIG. 3*c* is an overhead perspective view of the explosive from a standard module where a conical portion of the explosive has been removed from an end of the cylinder to shape the charge and to accommodate fitting a conical liner to in the standard module.

Referring to FIG. 3*a*, the removable semi-circular wedge of explosive 12*rsw* as shown end-on in FIG. 2;

Referring to FIG. 3*b*, the removable elliptical wedge 12*rew* of explosive as shown end-on in FIG. 2;

Referring to FIG. 3*c*, the explosive in a variation of the standard module has a partitioned explosive 12 with a removable conical wedge 12*rcw* of explosive that can be separated from the permanent explosive 12*p*, therein shaping the charge to accommodate a conical liner.

Figure 4:
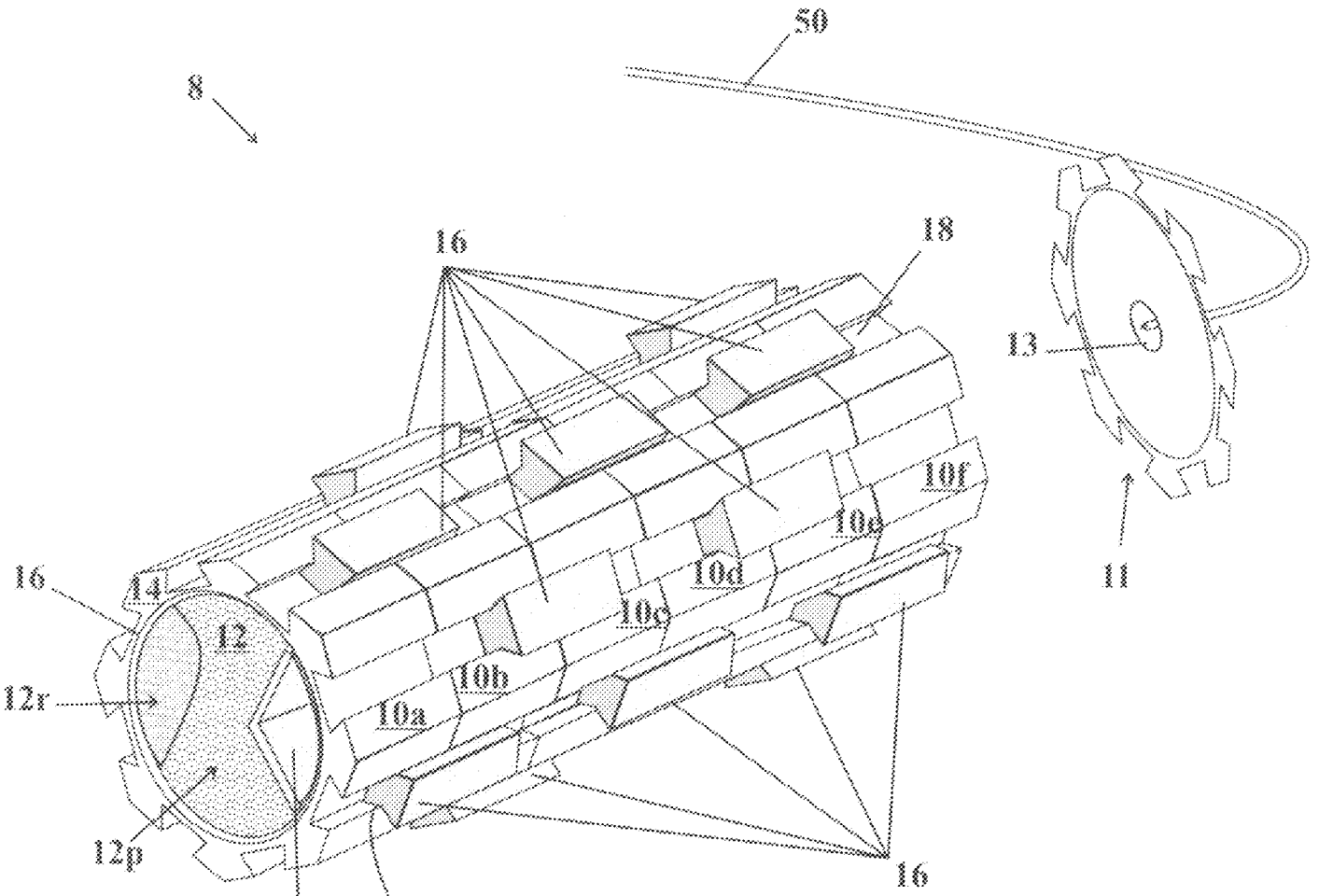
FIG. 4 is an overhead perspective view of a six module linear shaped charge (LSC), illustrating the use of slides in channels to join connecting consecutive modules, a casing floor with an igniter access port, where as shown at least several semi-circular wedges have been removed and a copper, magnesium, or glass substantially angle liner has been inserted.

Referring to FIG. 4, which is an overhead perspective view of a six module 10*a*-10*f* explosive device 8 that has been configured to have a right angle bar 44 projectile (EFP) made of metal, ceramic or other material. The slides 30 in the channels 18 span an interface of coupled modules. In the device 8, multiple semi-circular removable wedges have been removed to accommodate the inserted right angle bar 44. The elliptical removable portion 12*r* of the partitioned explosive has not been removed. The explosive, device is detonated with an igniter 50, which in the illustrated exemplary embodiment is a shock tube 50. The igniter 50 is mounted in an igniter access port 13. The igniter access port 13 is shown located in a closing module plate 11. This configuration may also be in a standard module having the igniter access port 13.

Figure 5:
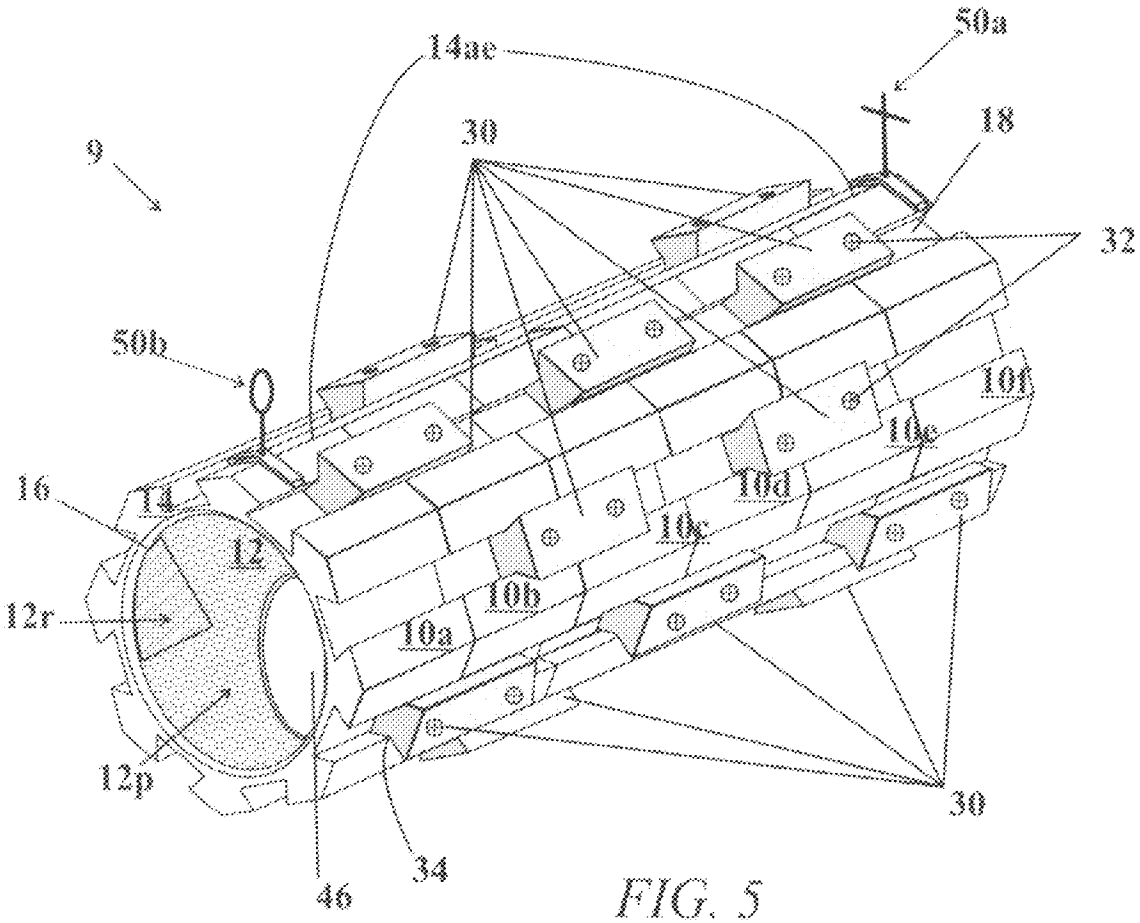
FIG. 5 is a linear shaped charge (LSC) modular explosive device similar to the LSC illustrated in FIG. 4, albeit in this assembly several of the elliptical wedges have been removed and a hemispherical copper liner is inserted, the slides are fitted with stops, which can be tightened, and the rail is fitted with an ancillary sight.

Referring to FIG. 5, which is a linear shaped charge device similar to device 8 illustrated in FIG. 4, albeit in this assembly several consecutive removable elliptical wedges have been removed and a hemispherical liner 46 is inserted forming the linear explosively formed projectile (EFP) 9. The semi-circular removable wedges 12*r* are retained. The slides 30 have notches 34, and are fitted with stops 32, which may be tightened. In addition to the apical edge 14*ae*, which is an intrinsic sighting mechanism, the rail 14 is fitted with an ancillary sight 50*a*, 50*b*.

The disclosed invention is highly suited for explosive ordnance disposal performed using dismounted operations. In particular, dismounted operations that require potentially everything to be manually carried, for instance in a backpack. The system is advantageous in that the explosive is already packed in standard modules, and may be configured into multiple explosive devices. Hand packing the explosive is not required, just the removal of pre-partitioned portions. The removed explosives may be utilized in breaching tools that use relatively narrow strips of explosive, generally in flexible elongate casings. The Removed explosives also may be safely stored in substantially empty standard modules. Packing materials, such as, plastic tags, may be used to minimize movement of the removed explosives.

The invented system condenses and consolidates the capabilities available from multiple explosives and explosive tools into substantially one relatively lightweight device suitable for dismounted operations.

Examples of varieties of explosive that are in common use in shape charges include cyclotrimethylene-trinitramine (RDX), cyclotetramethylenetetranitramine (HMX), pentaerythritoltetranitrate (PETN), hexanitrostilbene (HNS), and dipicramide (DiPam).

Cyclotrimethylenetrinitramine (RDX), a colorless explosive, is usually dyed pink for use in LSCs. RDX must be highly purified to insure stability at higher temperatures. Most LSCs contain RDX. Cyclotetramethylenetetranitramine (HMX) is very similar to RDX. HMX is white to colorless. It may be used at higher temperatures than RDX. Pentaerythritoltetranitrate (PETN) is less powerful and more sensitive than RDX. PETN is used primarily in detonators, but may be used in LSCs. Dipicramide (DiPam) is a relatively new explosive. It is less brisant and less sensitive than RDX. Hexanitrostilbene (HNS) is a new explosive also developed by NOL for high temperature applications.

An explosive composition includes substantially RDX with a plastic binder (usually polyisobutylene), a plasticizer (usually dioctyl sebacate or dioctyl adipate), and sometimes includes a motor oil.

The modular charge system in one exemplary embodiment includes a backpack, and a plurality of standard modules that may be axially coupled to at least one other module. The standard module has an, explosive in a casing having a substantially cylindrical wall with a plurality of external longitudinal, rails that run lengthwise. The rails are substantially parallel and approximately equidistantly spaced around the perimeter of the casing, where the space between a pair of rails defines a channel. The casing and rails function in-part as a cylindrical tamper around the explosive, where the explosive in the standard module is partitioned into substantially removable portions and permanent portions. The removable portions may be separated from the permanent portions and any retained removable portions using simple tools such as a spatula and a knife, therein enabling the standard module to be fitted with a variety of flying plates, bars, liners and other hardware. The system generally includes a plurality of flying plates of differing materials, a plurality of liners of different shapes and lengths, and of differing materials previously discussed that are known to be effective, especially to explosive ordnance disposal technicians, and a plurality of igniters. Shock tubing is generally favored, but the choice is influenced by the mission and the selection of the explosive. The system pack includes several module closing plates with an igniter access port, a stand for positioning the charge, several non-standard modules with no explosive for storing removed explosive and plastic bags to be used for cushioning removed explosive and storing water based liquids.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A modular charge system, comprising:

a standard module having a charge of explosive material, wherein said standard module is fitted with one of a flying plate, a liner, and a projectile, and wherein the standard module is coupled with other modules therein configuring a total charge of explosive material and a total weight and composition with the flying plate, the liner, the projectile and other hardware, wherein said standard module is axially coupled to at least one said other module, said standard module is comprised of an explosive enclosed in a casing having a substantially cylindrical wall with a plurality of external longitudinal rails that run lengthwise, wherein said rails are substantially parallel and approximately equidistantly spaced around the perimeter of the casing, wherein a space between a pair of rails defines a channel, said casing and rails functioning in-part as a cylindrical tamper around the explosive, wherein said explosive in the standard module is partitioned into substantially removable portions and permanent portions, wherein said removable portions is separated from the permanent portions and any retained removable portions, therein enabling the explosive material to be shaped and configured to multiple types of charges; and a coupling mechanism utilizing elongate internal slides, being positioned in channels for joining said one standard module to said at least one other module, wherein standardization and utilization of a partitioned explosive packed in at least one of the standard module and said at least one other module to condense and consolidate multiple explosives and explosive tools into a few relatively lightweight devices.

2. The modular charge system according to claim 1, wherein each rail is comprised of an upper left side, a upper right side, a left under side, a right under side, and a bottom that is contiguous with a perimeter wall of the casing, wherein said upper left side and said upper right side intersect to form an apical edge, wherein said left under side and said right under side of each of the casing's rails are undercut, each side to form a sloped undercut surface.

3. The modular charge system according to claim 2, wherein the type of charge is a shape charge, wherein the shaped charge is an explosively formed projectile, configured to use a plurality of coupled standardized modules, where a conical portion of the partitioned explosive is removed, therein to shape the explosive charge and enable room for a changeable conical liner to be fitted, and wherein the conical liner is comprised of material selected from one of copper, magnesium, and glass.

4. The modular charge system according to claim 2, wherein the type of charge is a linear shape charge, where a plurality of a modules are consecutively coupled, wherein said plurality of modules are comprised of removable portions, which are wedges substantially semi-circular in shape that are removable and replaceable by an inserted angled liner of a bar of similar dimensions, and wherein the liner is comprised of a material selected from one of copper, magnesium, and glass.

5. The modular charge system according to claim 2, wherein the type of charge is a linear shape charge, where a plurality of modules are consecutively coupled, wherein said plurality of modules comprise removable portions, which are wedges substantially elliptical in shape that are removable and replaceable by an inserted hemispherical copper liner of similar dimensions.

6. The modular charge system according to claim 2, wherein the slides include a notch, and wherein the slides are fitted with stops, which are tightenable to prevent any further movement of the slides relative to the channel.

7. The modular charge system according to claim 1, wherein the type of charge is a flyer plate configured to use a single standardized module with the partitioned explosive, where the explosive is slightly recessed from a rim of the casing, and substantially none of the removable portions of the partitioned explosive have been removed, and wherein the standard module is fitted with a changeable plate comprised of material selected from one of steel, copper, and aluminum.

8. The modular charge system according to claim 1, further comprising an igniter access port.

9. The modular charge system according to claim 1, further comprising an ancillary sight, wherein the ancillary sight is mounted on an external longitudinal rail.

10. The modular charge system according to claim 1, wherein the explosive is selected from one of cyclo-trimethylene-trinitramine (RDX), cyclotetramethylenetetra-nitramine (HMX), pentaerythritoltetranitrate (PETN), hexa-nitrostilbene (HNS), and dipicramide (DiPam).

11. A modular charge system, comprising:

a backpack;

a plurality of standard modules being axially coupled to at least one other module, wherein each of said plurality of standard modules is comprised of an explosive in a casing, which has a substantially cylindrical wall with a plurality of rails that run lengthwise, wherein said rails are substantially parallel and approximately equidistantly spaced around the perimeter of the casing, wherein a space between a pair of said plurality of rails defines a channel, wherein said casing and said plurality of rails define a cylindrical tamper around the explosive, wherein said explosive in one of said plurality of standard modules is partitioned into substantially removable portions and permanent portions, wherein said removable portions are separated from the permanent portions and any retained removable portions, therein to enable the standard module to be fitted with at least-one of a flying plate, a liner, and a projectile;

a plurality of flying plates;

a plurality of liners;

a plurality of projectiles;

a plurality of igniters;

a closing module plate; and a coupling mechanism utilizing elongate internal slides, for positioning in a plurality of channels for joining one of said plurality of standard modules to another of said plurality of modules, wherein said explosive, which is partitioned, enables consolidating multiple explosives and explosive tools into a plurality of lightweight devices, and wherein said plurality of rails are a plurality of external longitudinal rails.

12. The modular charge system according to claim 11, wherein each of said plurality of rails is comprised of an upper left side, a upper right side, a left under side, a right under side, and a bottom, which is contiguous with a perimeter wall of the casing, wherein said upper left side and said upper right side intersect to form an apical edge, and wherein said left under side and said right under side of each of the plurality of rails is undercut so that each side forms a sloped undercut surface.

13. The modular charge system according to claim 11, further comprising a stand for positioning the charge.

14. The modular charge system according to claim 11, further comprising an empty standard module initially absent an explosive, where said empty standard module is used to store a removed explosive, and wherein plastic bags are used to cushion and store water based solutions.

15. A standard module for shaped charges, comprising:

a casing having a substantially cylindrical wall with a plurality of rails that run lengthwise, wherein said plurality of rails are substantially parallel and approximately equidistantly spaced around the perimeter of the casing, wherein a space between a pair of said plurality of rails defines a channel, wherein said casing and said plurality of rails define a cylindrical tamper around an explosive contained within said casing, wherein said explosive is partitioned into removable portions and permanent portions, wherein the removable portions are separated from the permanent portions and any retained removable portions, therein to enable each said standard module to be fitted with one of a flying plates, liners, and a projectiles; and a coupling mechanism utilizing elongate internal slides, being positioned in a plurality of channels for joining said standard module to another said standard module, wherein said plurality of rails are a plurality of external longitudinal rails.

16. The standard module according to claim 15, wherein each of said plurality of rails is comprised of an upper left side, a upper right side, a left under side, a right under side, and a bottom, which is contiguous with a perimeter wall of the casing, wherein said upper left side and said upper right side intersect to form an apical edge, and wherein said left under side and said right under side of each of the plurality of rails is undercut so that each of said side forms a sloped undercut surface.

17. The standard module according to claim 15, wherein the shape charge is an explosively formed projectile, configured to use a plurality of coupled said standard modules, wherein a conical portion of the explosive, which is partitioned, is removable therein to shape the explosive charge and enable room for a changeable conical liner to be fitted to the standard module.

18. The standard module according to claim 17, wherein the conical liner is comprised of material selected from one of copper, magnesium, and glass.

19. The standard module according to claim 15, wherein the explosive is selected from one of cyclo-trimethylene-trinitramine (RDX), cyclotetramethylenetetra-nitramine (HMX), pentaerythritoltetranitrate (PETN), hexa-nitrostilbene (HNS), and dipicramide (DiPam).

20. A modular charge system, comprising:

a standard module including a charge of explosive material, wherein said standard module is fitted with one of a flying plate, a liner, and a projectile, wherein said standard module is coupled with at least another said standard module therein to configure a total charge of explosive material a total weight and composition with said at least one of the flying plate, the liner, and the projectile, wherein said standard module is axially coupled to said at least another said standard module, wherein said standard module is comprised of an explosive enclosed in a casing, which has a substantially cylindrical wall with at least two rails that run lengthwise, wherein said at least two rails are substantially parallel and spaced around the perimeter of the casing, wherein a space between a pair of rails defines a channel, wherein said casing and said pair of rails define a cylindrical tamper around the explosive, wherein said explosive in the standard module is partitioned into substantially removable portions and permanent portions, wherein said removable portions are separated from the permanent portions and any retained removable portions, therein to enable the explosive material to be shaped and configured to multiple types of charges; and a coupling mechanism utilizing elongate internal slides, being positioned in the channels to join one said standard module to another said standard module, wherein said explosive, which is partitioned, is packed in the standard module to enable condensing and consolidating multiple said explosives and explosive tools into a plurality of lightweight devices, and wherein said at least two rails are at least two external longitudinal rails.

* * * * *